US010286439B2

(12) United States Patent
Jin et al.

(10) Patent No.: US 10,286,439 B2
(45) Date of Patent: May 14, 2019

(54) HOT STAMPING METHOD

(71) Applicant: MS AUTOTECH CO., LTD., Gyeongju-si (KR)

(72) Inventors: Hong Kyo Jin, Hwaseong-si (KR); Jae Sin Yang, Cheonan-si (KR); Jae Hyung Park, Guri-si (KR); Tae Kyu Lee, Seoul (KR)

(73) Assignees: MS AUTOTECH CO., LTD., Gyeongju-si (KR); MYUNGSHIN INDUSTRY CO., LTD., Gyeongju-si (KR)

( * ) Notice: Subject to any disclaimer, the term of this patent is extended or adjusted under 35 U.S.C. 154(b) by 0 days.

(21) Appl. No.: 15/852,301

(22) Filed: Dec. 22, 2017

(65) Prior Publication Data

US 2018/0236520 A1 Aug. 23, 2018

(30) Foreign Application Priority Data

Feb. 17, 2017 (KR) ..... 10-2017-0021686

(51) Int. Cl.
*B21D 35/00* (2006.01)
*B21D 22/20* (2006.01)
*B21D 22/02* (2006.01)

(52) U.S. Cl.
CPC ..... *B21D 35/005* (2013.01); *B21D 22/022* (2013.01); *B21D 22/208* (2013.01); *B21D 35/001* (2013.01)

(58) Field of Classification Search
CPC .... B21D 22/02; B21D 22/022; B21D 35/005; C21D 9/0062
See application file for complete search history.

(56) References Cited

U.S. PATENT DOCUMENTS

| | | | | |
|---|---|---|---|---|
| 6,296,805 | B1 | 10/2001 | Laurent et al. | |
| 6,332,385 | B1 * | 12/2001 | Kautto | B23B 1/00 82/47 |
| 2011/0094282 | A1 * | 4/2011 | Overrath | B21D 22/022 72/342.1 |
| 2014/0191536 | A1 * | 7/2014 | Elfwing | C21D 9/0068 148/529 |
| 2014/0352388 | A1 * | 12/2014 | Balint | B21D 22/022 72/342.5 |

FOREIGN PATENT DOCUMENTS

| | | | |
|---|---|---|---|
| GB | 1490535 | A | 11/1977 |
| KR | 2014-0077005 | A | 6/2014 |
| KR | 1575557 | B1 | 12/2015 |

* cited by examiner

*Primary Examiner* — Pradeep C Battula
(74) *Attorney, Agent, or Firm* — STIP Law Group, LLC

(57) ABSTRACT

Provided is a method for manufacturing vehicle parts having ultra-high strength of 500 Mpa or more by using hot stamping. The method includes: forming a heated blank in a press forming apparatus; and taking out the formed blank from the press forming apparatus and consecutively cutting the blank with a trimming die. A blank temperature at the time of trimming may be 150° C. to 330° C.

3 Claims, 2 Drawing Sheets

HOT STAMPING METHOD

CROSS-REFERENCE TO RELATED APPLICATION

This application claims the benefit of Korean Patent Application No. 10-2017-0021686, filed on Feb. 17, 2017, the disclosure of which is incorporated herein in its entirety by reference.

BACKGROUND

The present invention relates to a method for manufacturing vehicle parts, in particular, parts having high strength of 1500 Mpa or more by using hot stamping.

As the fuel efficiency regulations or safety regulations are strengthened, there is a very high demand for lightweight and high-strength vehicle bodies. As a result, ultra-high strength steel parts with ultimate tensile strength of 1 GPa have been commercialized, and the development of steels having tensile strength of 2 GPa has been recently promoted.

Generally, if a strength of a steel sheet increases, an extension rate is lowered, resulting in a deterioration in processability. One of the technologies proposed for solving this problem is the hot stamping technology. The hot stamping technology was disclosed in British Patent No. 1490535 in the 1970s.

In the hot stamping technology, a steel sheet is heated to a high temperature of, for example, 900° C. or higher and then press-formed and quenched to produce high strength steel part. For the hot stamping, boron steels are used which contain carbon of about 0.2 wt % and use manganese (Mn) and boron (B) as elements for improving heat treatment performance.

Since the hot stamping is performed at high temperature, surface oxidation of steel sheets occurs. In order to solve this problem, aluminum coated steel sheets are proposed. Aluminum coated steel sheets are disclosed in U.S. Pat. No. 6,296,805. A representative example of the aluminum coated steel sheet is Usibor 1500 based on 22MnB5 boron steel.

TABLE 1

(Rough composition of 22MnB5, Unit: wt %)

| C | Mn | Si | S | Cr | Al | B | Ti |
|---|---|---|---|---|---|---|---|
| 0.21~0.25 | 1.10~1.35 | 0.15~0.40 | ≤0.010 | 0.10~0.25 | ≤0.080 | 0.0015~0.0040 | 0.15~0.045 |

The hot-stamped parts have problems with trimming. Conventional vehicle parts are cut by using a trimming die, but hot-stamped parts having tensile strength of 1500 Mpa are too strong to cut or pierce by using a trimming die.

In order to cut the hot-stamped parts by using the trimming die, an expensive high-hardness tool steel is required. However, due to frequent damage of the trimming tool, there is a limitation in applying to mass production. Laser is currently used for trimming the hot-stamped parts.

A laser cutter is expensive and productivity of it is relatively low. It takes about 60 seconds to trim a hot-formed body part.

Korean Patent Application Publication No. 2014-0077005 discloses a method for resolving inefficiency of the laser trimming. According to this method, a steel sheet is primarily subjected to shear deformation along a cutting line when formed at 650° C. to 950° C., and then secondarily cut along the cutting line at room temperature.

The method disclosed in Korean Patent Application No. 2014-0077005 is not impossible, but is not suitable for mass production. And further, the configuration of the press forming apparatus becomes complicated, and the edge line by such cutting is not clean. Thus, a post-processing will be required.

Korean Patent Registration No. 1575557 proposes a method for completing trimming while press-forming a steel sheet. A preferable trimming temperature suggested in this patent is 500° C. to 600° C.

The Korean patents are intended to complete trimming partially or completely when the strength of the steel sheet is low before the steel sheet is transformed from austenite to martensite at high temperature. However, according to these patents, the press forming apparatus becomes complicated and cutting quality is not guaranteed.

As of now, the hot-stamped parts having tensile strength of 1500 Mpa are laser-trimmed. The parts that have been formed in the press forming apparatus are loaded in a pallet positioned near the press forming apparatus, cooled to room temperature, transferred together, and then cut in a processing line for laser trimming.

SUMMARY

The present invention is based on the recognition of the related art described above, and provides a method capable of trimming hot-stamped parts having ultra-high strength of 1500 Mpa at low costs.

Also, the present invention provides a method for trimming hot-stamped parts, which can replace laser trimming, provide excellent productivity, and reduce costs.

The problems to be solved by the present invention are not necessarily limited to those mentioned above, and other matters not mentioned herein may be understood by the following description.

A method for trimming hot-stamped parts according to the present invention includes: forming a heated blank in a press forming apparatus; and taking out the formed blank from the press forming apparatus and consecutively cutting the blank with a trimming die. The term "consecutively" may mean that the blank taken out from the press forming apparatus is directly transferred to a trimming die and a cutting process is performed thereon.

Conventionally, hot-formed parts were transferred to a pallet and cooled to almost room temperature. The processing line for laser trimming is away from the processing line for hot forming. However, a preferred example intended by the present invention is that any process is not involved between hot forming and trimming. In addition, the present invention intends not to heat the parts between hot forming and trimming. Such heating of the parts before trimming is inconvenient and causes an increase in costs.

According to an embodiment of the present invention, the blank temperature at the time of trimming is 170° C. to 330° C., preferably 190° C. to 320° C., and more preferably 195° C. to 310° C.

Conventionally, the heated blank was cooled to 150° C., almost to 100° C., in the press forming apparatus. This is a common sense in the field of hot stamping, and no one has raised a question about this common sense. Conventionally, the blank cooled to almost 100° C. in the press forming apparatus was loaded near the press forming apparatus, cooled to room temperature, and then transferred to the processing line for laser trimming and cut by a laser cutter.

The martensite finish temperature (Mf) of 22MnB5 boron steel, that is, the temperature at which the transformation from austenite to martensite finishes on cooling, is about 220° C. to 230° C. The Mf temperature of the blank transformed by quenching can be slightly increased, but it has been believed that a martensite phase of almost 100% can be obtained by cooling the blank down to 150° C., or safely down to about 100° C. in the press forming apparatus.

However, according to the embodiment of the present invention, it is unnecessary to cool the blank down to 100° C. in the press forming apparatus. The blank can be taken out from the press forming apparatus at a temperature of 200° C. or higher. Then, the blank is transferred to the trimming die and cut in a temperature range of 150° C. to 330° C., preferably 170° C. to 320° C., more preferably 190° C. to 320° C., and still more preferably 195° C. to 310° C.

The upper limit of the temperature at which the blank is taken out from the press forming apparatus is about 350° C. The temperature at which the blank is taken out from the press forming apparatus may be determined by taking into account the time interval from the start time of transferring the blank to the completion time of the trimming, the temperature drop of the blank during the time interval, and the targeted strength of the parts to be guarantee According to the embodiment, it is important to perform trimming consecutively after press-forming the heated blank. Even if the blank cooled to room temperature after the press forming is heated again to a temperature of, for example, 190° C. to 350° C., the reduction in load or force (hereinafter, 'shear load') required for cutting the blank is insignificant.

The present invention is based on a new discovery that the shear load for a hot-formed boron steel blank at 190° C. to 330° C. immediately after hot forming is lowered to a shear load level of a steel having tensile strength of 1180 Mpa, and that the hot-formed boron steel blank has the targeted tensile strength of 1500 Mpa even if the hot-formed boron steel blank is trimmed in the above temperature range consecutively after the hot forming. The composition of the boron steel blank is designed to have tensile strength of 1500 Mpa by a hot stamping process as recommended and the trimmed boron steel blank is air-cooled. The fact, that the boron steel blank designed to have tensile strength of 1500 Mpa has tensile strength of 1500 Mpa after the hot stamping, means that almost 100% of the martensite transformation has been achieved as intended. In this document, the shear load will be expressed using tensile strength for easy explanation and for intuitive and simplified understanding.

In view of the existing firm belief that the blank should be cooled below 200° C., practically down almost to 100° C., in the forming die for hot stamping, in order to achieve the present invention, it is necessary to overcome the stereotypes that the method proposed by the present invention may cause different phases other than martensite in the hot-stamped parts or reduce the strength or elongation of the parts, or the quality will not be constant, or the reduction in shear load in the above temperature range will not be meaningful.

According to the embodiment of the present invention, the lower temperature limit for trimming may be 190° C., or down to 170° C. The shear load increases a little bit high though, the lowest temperature for trimming can be 150° C. The shear load for the parts at about 170° C. right after the press forming exhibits a level of about 1300 Mpa. The shear load is higher than that of a body part having tensile strength of 1180 Mpa, but it is much easier than cutting a body part having tensile strength of 1500 Mpa with the trimming die. Cost reduction is expected to some degrees when the present invention is applied to commercial production processes. There is an opportunity for cost reduction when the present invention is applied to commercial production processes. In the past, there has been no example of cutting the blank by using the trimming die immediately or consecutively after hot forming.

So far, no attempt has been made beyond the above stereotypes. As in Korean Patent Application Publication No. 2014-0077005 and Korean Patent Registration No. 1575557 described above, there has been attempts to trim when forming the blank.

BRIEF DESCRIPTION OF THE DRAWINGS

Embodiments of the present invention will be more clearly understood from the following detailed description taken in conjunction with the accompanying drawings in which.

DETAILED DESCRIPTION OF THE EMBODIMENTS

Figure 1:
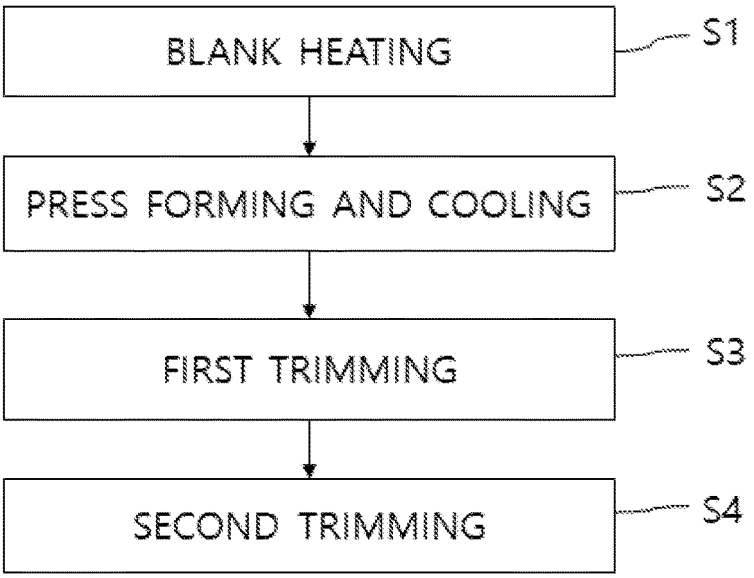
FIG. 1 is a flowchart of a trimming process according to an embodiment of the present invention.

Hereinafter, the present invention will be described in detail with reference to the accompanying drawings. For convenience of description, like reference numerals are assigned to refer to like elements throughout the drawings.

A method for trimming hot-stamped parts according to an embodiment will be described with reference to FIGS. 1 and 2.

Blank Heating (S1)

A blank made of 22MnB5 boron steel can be used. As one example, an Al-coated steel sheet of Usibor 1500 proposed by ArcelorMittal can be used.

TABLE 2

(Rough composition of Usibor, Unit: wt % )

| C | Mn | Si | S | Cr | Al | B | Ti |
|---|---|---|---|---|---|---|---|
| 0.2~0.25 | 1.10~1.35 | 0.15~0.35 | ≤0.008 | 0.15~0.30 | 0.02~0.06 | 0.002~0.004 | 0.02~0.05 |

For the heating of the blank, an electric heating furnace, a gas heating furnace, or a hybrid heating furnace proposed in U.S. Patent Publication No. 2010/0086002 can be used. Also, various heating methods applicable to hot stamping, such as direct electric resistance heating or high-frequency induction heating can be used.

The blank may be heated to an austenitization temperature ($Ac_3$), for example, 880° C. to 950° C. As an example, the blank may have a ferritic-pearlitic microstructure at room temperature, and may have a single austenite phase above the austenitization temperature. For reference, the temperature A3 in low carbon steels is a temperature at which the alpha ferrite changes to austenite or the austenite reverts to alpha ferrite. The "c" is from the French word chauffage, meaning heating.

Press Forming and Cooling (S2)

The heated blank is formed and quenched in a press forming apparatus. A forming start temperature is 600° C. to 900° C., preferably 650° C. to 850° C., above a martensite transformation start temperature (Ms) of the blank.

The forming of the blank is started in the above temperature range, and the blank is cooled at a temperature below Ms. In some cases, the blank may be intended to have a locally softened region during a forming process.

The cooling speed of the blank may be 25° C./sec or more, preferably 27° C./sec or more, and more preferably 30° C./sec or more. The blank may be quenched at a speed of about 200° C./sec in a press forming apparatus having cooling channels.

The quenched blank is taken out from the press forming apparatus at a temperature of 200° C. or higher, and preferably 220° C. to 350° C., and transferred to a trimming die disposed near the press forming apparatus. The blank may be transferred by using a robot at room temperature under atmospheric condition.

Meanwhile, the blank quenched in the press forming apparatus may be taken out at a temperature of below 200° C. When the press-formed blank is trimmed at 170° C., the shear load may be mid-1300 Mpa. The strength of the press-formed blank is slightly high though, the trimming die can be applicable. However, when taking into account the lifespan of the cutting tool of the trimming die, the temperature at which the blank is taken out from the press forming apparatus is preferably 200° C. or higher, and more preferably 250° C. or higher.

When the upper limit of the temperature at which the blank is taken out from the press forming apparatus exceeds 350° C., more critically 360° C., it can be impossible to obtain parts having the targeted tensile strength of 1500 Mpa.

Trimming (S3 and S4)

The trimming is to cut the edges of the formed part along a desired shape line. Although not separately described, piercing or the like can be performed together during the trimming process.

After the press forming, the blank is cut or trimmed in the trimming die. The temperature of the blank to be trimmed can be broadly 150° C. to 330° C., preferably 170° C. to 320° C., more preferably 190° C. to 320° C., and still more preferably 195° C. to 310° C. When the shear load of 1180 Mpa or less is targeted, it may be safe to perform the trimming process in the range of 200° C. to 310° C.

When the blank temperature at the time of trimming process is lower than 190° C., for example, about 170° C., the shear load for the blank increases to mid and late 1300 Mpa. Considering the transferring time of the blank, if the blank temperature when trimming exceeds 350° C., the tensile strength of 1500 Mpa may not be obtained. In addition, when the trimming temperature rises, the thermal load may cause a damage to the trimming tool. Therefore, the preferable blank temperature at the time of trimming is 320° C. or lower, more preferably 310° C. or lower, and still more preferably 300° C. or lower.

The trimming using dies may be completed at one time even it will be very rare cases and may be performed twice or more times so as to separate chips or not to complicate the design of the cutting line of the blank. As illustrated in FIG. 2, two trimming dies 30 and 40 may be sequentially disposed near the press forming apparatus 20.

Figure 2:
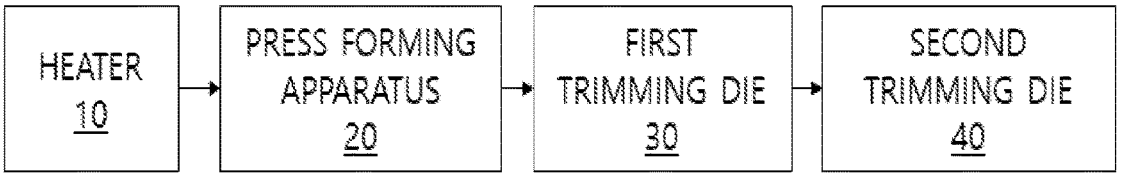
FIG. 2 is a schematic diagram for describing a configuration of a trimming apparatus according to an embodiment of the present invention.

As illustrated in FIG. 1, the blank temperature at the time of first trimming may be 220° C. to 320° C., and the blank temperature at the time of second trimming may be 190° C. to 300° C. The lower limit of the second trimming temperature may be 170° C., or more extremely down to 150° C. However, for stable operation in a commercial production line, the final trimming is preferably performed at 190° C. or higher, and more preferably 195° C. or higher.

The above temperature conditions are derived as the optimal condition by taking into account the transfer time between the press forming apparatus 20 and the first trimming die 30 and between the first trimming die 30 and the second trimming die 40, the cutting time in each trimming die, various possible time delays, the quality of the hot-stamped parts, and the like. A means for keeping the temperature of the blank within the trimming temperature range have not been considered in the embodiments.

Each of the trimming dies 30 and 40 may be equipped with a temperature sensor for checking the above temperature condition. A heater for keeping the blank temperature in the above condition may be mounted, but the heater need not be mounted according to results of many experiments. In order to mount the heater, a design change for a commercial trimming die is required. This causes an increase in manufacturing costs and maintenance costs, and thus is not preferred.

The trimming temperature condition according to the embodiment will be described in more detail with reference to FIGS. 3 and 4. It should be understood that only a part of a plurality of experimental examples are extracted for the sake of explanation. In the experiment, Al coated steel sheet that is made of 22MnB5 boron and designed to have a tensile strength of 1500 Mpa grade was used.

Figure 3:
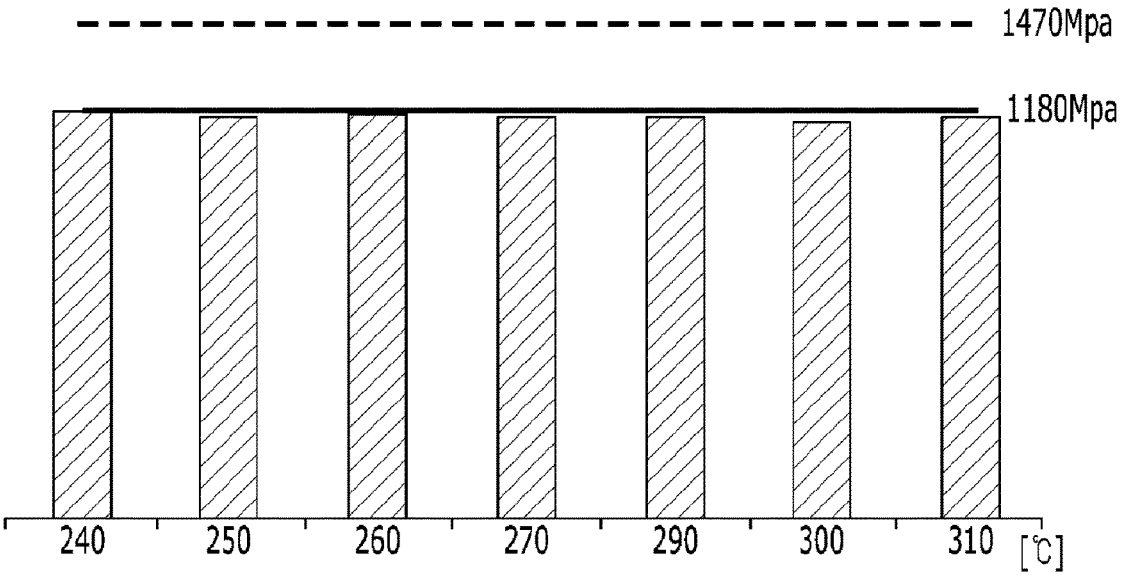
FIG. 3 is a graph showing a change in shear load for a specimen according to a first trimming temperature according to an embodiment of the present invention.

FIG. 3 is a graph showing a change in shear load according to a blank temperature at the time of first trimming. In FIG. 3, a vertical axis represents shear load, but is replaced by a maximum tensile load of the specimen for convenience. It should be understood that tensile load is used instead of shear load for convenience.

As illustrated in FIG. 3, the shear loads of the specimens shows a level of 1180 Mpa or less in the temperature range of 240° C. to 310° C. In other words, the shear loads of the specimens in the temperature range of 240° C. to 310° C. after hot forming correspond to those of steel sheets with tensile strength of 1180 Mpa or less. There will be a slight difference based on the composition though, the specimens at 320° C., and further at 330° C., after the press forming show shear load of 1180 Mpa or less, and show the targeted tensile strength of 1500 Mpa when completely cooled to room temperature.

Figure 4:
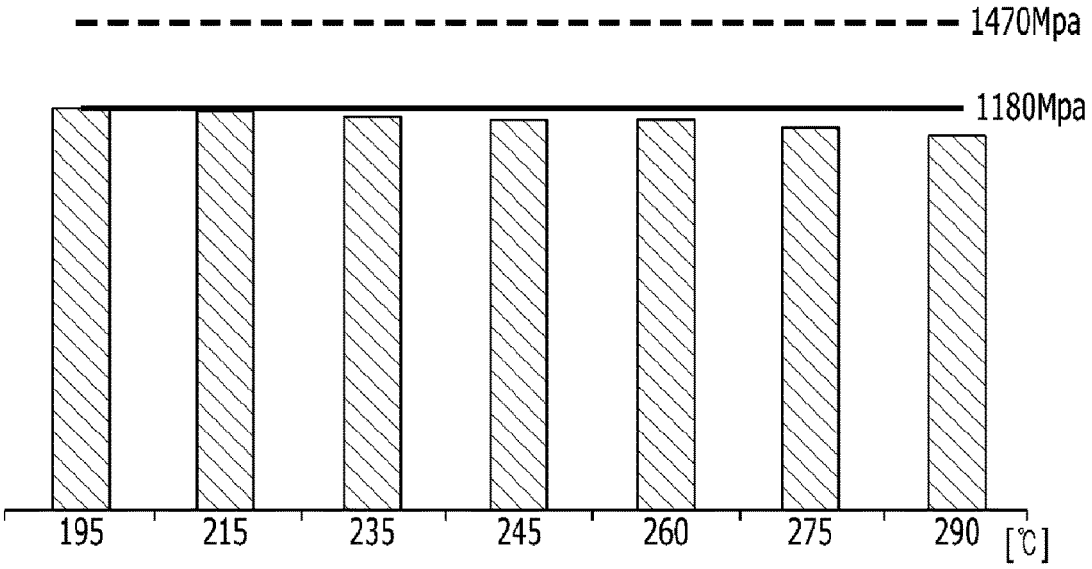
FIG. 4 is a graph showing a change in shear load for a specimen according to a second trimming temperature according to an embodiment of the present invention.

FIG. 4 is a graph showing a change in shear load according to a blank temperature at the time of second trimming. In FIG. 4, a vertical axis represents shear load, but is replaced by a maximum tensile load of the specimen for convenience.

As illustrated in FIG. 4, the shear loads of the specimens show a level of 1180 Mpa or less in the temperature range of 195° C. to 290° C. The specimens air-cooled to room temperature after trimming show the targeted tensile strength of 1500 Mpa.

As can be seen from the above results, the blank after hot forming reduces the shear load to 1180 Mpa in the temperature range of 190° C. to 310° C., and further 190° C. to 330° C. Since the blank temperature drop of about 120° C. to 140° C. can be allowed during the trimming process, it is not necessary to heat the blank in the course of the process.

The parts that are air-cooled or cooled in a atmospheric conditions after the first and second trimmings have the targeted tensile strength of 1500 Mpa grade, more specifically ultra-high strength of 1480 Mpa or more, and exhibit elongation of 6% or more. This result shows that the hot-stamped parts have a martensite phase close to 100% according to embodiments.

Meanwhile, once the hot-stamped parts that are cooled to room temperature after press forming, even if the parts are reheated to the trimming temperature range according to the embodiment of the present invention, the shear loads of the parts are in mid to late 1400 Mpa and not reduced to the level of 1180 Mpa.

According to the present invention described above, it is possible to trim the hot-stamped parts having ultra-high strength of 1500 Mpa or more at low costs. The trimming die has excellent productivity because of a short stroke time of a few seconds and is inexpensive.

Further, according to the present invention, a commercially available trimming die used for cutting automobile steel sheets or parts can be used without any design modification, and expensive laser trimming can be replaced by trimming using a die.

While specific embodiments of the present invention have been illustrated and described, it will be understood by those skilled in the art that changes may be made to those embodiments without departing from the spirit and scope of the invention that is defined by the following claims.

What is claimed is:

1. A hot stamping method comprising:

(a) heating a blank to an austenitization temperature of the blank or more;

(b) forming the heated blank in a press forming apparatus, wherein the forming of the blank is started at a temperature of 600° C. to 900° C. and the heated blank is cooled to below a martensite transformation start temperature (Ms) of the blank at a speed of 25° C./sec or more; and (c) taking out the formed blank from the press forming apparatus and consecutively cutting the formed blank with a trimming die, wherein a blank temperature at the time of cutting is 150° C. to 330° C., wherein, in the step (c), the formed blank is taken out from the press forming apparatus at a temperature 250° C. to 350° C.; the formed blank is sequentially cut by using at least two trimming dies; the formed blank is not reheated during the entire process of trimming; and a final trimming is performed at 170° C. or higher.

2. The hot stamping method of claim 1, wherein, the formed blank temperature at the time of cutting is 190° C. to 320° C.

3. The hot stamping method of claim 2, wherein, in the step (c) of sequentially cutting by using at least two trimming dies, the temperature of the formed blank cut in the first trimming die after press forming is 220° C. to 320° C., and the temperature of the formed blank cut in the second trimming die is 190° C. to 300° C.

* * * * *